US008602744B2

(12) United States Patent
Ward

(10) Patent No.: US 8,602,744 B2
(45) Date of Patent: Dec. 10, 2013

(54) CONDENSATE PUMP

(75) Inventor: Charles Barry Ward, Alpharetta, GA (US)

(73) Assignee: Diversitech Corporation, Duluth, GA (US)

( * ) Notice: Subject to any disclaimer, the term of this patent is extended or adjusted under 35 U.S.C. 154(b) by 1035 days.

(21) Appl. No.: 12/244,152

(22) Filed: Oct. 2, 2008

(65) Prior Publication Data

US 2011/0085917 A1 Apr. 14, 2011

Related U.S. Application Data

(63) Continuation-in-part of application No. 11/277,445, filed on Mar. 24, 2006, now abandoned, which is a continuation-in-part of application No. 12/190,212, filed on Aug. 12, 2008.

(60) Provisional application No. 60/665,533, filed on Mar. 25, 2005, provisional application No. 60/956,741, filed on Aug. 20, 2007, provisional application No. 60/976,962, filed on Oct. 2, 2007.

(51) Int. Cl.
*F04B 49/00* (2006.01)

(52) U.S. Cl.
USPC ..... 417/36

(58) Field of Classification Search
USPC ..... 417/36, 423.3; 73/304 C; 137/392
See application file for complete search history.

(56) References Cited

U.S. PATENT DOCUMENTS

| | | | | | |
|---|---|---|---|---|---|
| 2,776,554 | A | | 1/1957 | Pigman | |
| 2,822,442 | A | | 2/1958 | Jones | |
| 2,918,016 | A | | 12/1959 | Olson | |
| 2,971,467 | A | | 2/1961 | Konopka et al. | |
| 2,981,196 | A | | 4/1961 | Zimmermann et al. | |
| 3,696,629 | A | | 10/1972 | Heston | |
| 3,758,236 | A | * | 9/1973 | Zimmerman | 417/360 |
| 3,863,147 | A | * | 1/1975 | Erath | 324/678 |
| 4,444,051 | A | * | 4/1984 | Yamaki et al. | 73/304 C |
| 4,780,705 | A | * | 10/1988 | Beane | 340/620 |
| 4,875,497 | A | * | 10/1989 | Worthington | 137/2 |
| 4,881,873 | A | * | 11/1989 | Smith et al. | 417/12 |
| 4,888,989 | A | * | 12/1989 | Homer | 73/304 C |
| 4,897,023 | A | | 1/1990 | Bingler | |
| 4,912,976 | A | * | 4/1990 | Labriola, II | 73/290 R |
| 4,982,576 | A | | 1/1991 | Proctor et al. | |
| 5,012,768 | A | | 5/1991 | Roschinski | |
| 5,017,909 | A | * | 5/1991 | Goekler | 340/620 |
| 5,031,068 | A | * | 7/1991 | Hansen et al. | 361/284 |
| 5,135,485 | A | * | 8/1992 | Cohen et al. | 604/67 |
| 5,188,710 | A | | 2/1993 | Weber et al. | |

(Continued)

*Primary Examiner* — Devon Kramer
*Assistant Examiner* — Amene Bayou
(74) *Attorney, Agent, or Firm* — Smith Gambrell & Russell LLP

(57) ABSTRACT

A condensate pump for an HVAC system includes a reservoir for collecting condensate water, a pump motor connected to an impeller pump for pumping the condensate water out of the reservoir, and a floatless pump controller. The floatless pump controller detects the water level in the reservoir and, based on the water level in the reservoir, controls the operation of the pump motor, and if necessary, sounds an alarm and shuts down the HVAC system. The floatless pump controller may employ an ultrasonic transducer or capacitance sensors to detect the level of condensate water in the reservoir.

7 Claims, 14 Drawing Sheets

(56) References Cited

U.S. PATENT DOCUMENTS

| | | | | |
|---|---|---|---|---|
| 5,201,339 | A | 4/1993 | Buchan et al. | |
| 5,238,369 | A * | 8/1993 | Farr | 417/18 |
| 5,265,482 | A * | 11/1993 | Davis et al. | 73/863.01 |
| 5,461,879 | A | 10/1995 | Bolton et al. | |
| 5,498,914 | A * | 3/1996 | De Boer | 307/116 |
| 5,562,003 | A | 10/1996 | Lefebvre | |
| 5,651,259 | A | 7/1997 | Twyman | |
| 5,667,362 | A | 9/1997 | Murai et al. | |
| 5,722,290 | A * | 3/1998 | Kronberg | 73/304 C |
| 5,856,783 | A * | 1/1999 | Gibb | 340/618 |
| 6,042,342 | A | 3/2000 | Orian | |
| 6,106,225 | A | 8/2000 | Enns | |
| 6,125,696 | A * | 10/2000 | Hannan et al. | 73/304 C |
| 6,192,752 | B1 * | 2/2001 | Blaine | 73/290 R |
| 6,322,326 | B1 | 11/2001 | Davis et al. | |
| 6,341,944 | B1 | 1/2002 | Butcher | |
| 6,372,126 | B1 | 4/2002 | Reeves | |
| 6,499,961 | B1 * | 12/2002 | Wyatt et al. | 417/36 |
| 6,565,325 | B2 | 5/2003 | Belehradek | |
| 6,568,264 | B2 * | 5/2003 | Heger | 73/304 C |
| 6,847,291 | B2 * | 1/2005 | Kemp | 340/521 |
| 7,127,943 | B1 * | 10/2006 | Griffiths et al. | 73/304 C |
| 7,150,190 | B2 * | 12/2006 | Krufka et al. | 73/304 C |
| 7,264,449 | B1 * | 9/2007 | Harned et al. | 417/36 |
| 2002/0157465 | A1 * | 10/2002 | Marioni | 73/313 |
| 2002/0176782 | A1 | 11/2002 | Batchelder et al. | |
| 2007/0166169 | A1 | 7/2007 | Venkatachari et al. | |
| 2007/0224050 | A1 | 9/2007 | Ward | |
| 2008/0095638 | A1 | 4/2008 | Branecky | |
| 2008/0229819 | A1 | 9/2008 | Mayleben et al. | |
| 2009/0129939 | A1 | 5/2009 | Hampton | |

* cited by examiner

CONDENSATE PUMP

CLAIM OF PRIORITY

This application is a continuation-in-part of U.S. patent application Ser. No. 11/277,445, filed Mar. 24, 2006 now abandoned, which claims priority from U.S. Provisional Patent Application Ser. No. 60/665,533, filed on Mar. 25, 2005, this application is a continuation-in-part of copending U.S. patent application Ser. No. 12/190,212, filed Aug. 12, 2008, which claims priority from U.S. Provisional Patent Application Ser. No. 60/956,741, filed on Aug. 20, 2007, and this application claims priority from U.S. Provisional Patent Application Ser. No. 60/976,962, filed on Oct. 2, 2007, which is incorporated herein in its entirety.

FIELD OF THE INVENTION

The invention relates to a condensate pump that collects condensate water from the evaporator of an HVAC system and pumps the condensate water to another location for disposal. More specifically, the condensate pump of the present invention includes a floatless water level sensing device.

BACKGROUND OF THE INVENTION

A condensate pump is used in an HVAC system to collect condensate water from the evaporator of the HVAC system and to pump the condensate water to a remote location for disposal. Particularly, the condensate pump typically comprises a reservoir, an impeller pump for pumping the water out of the reservoir to the remote location, and an electric motor to drive the impeller pump. Typically, a float detects the level of condensate water in the reservoir and activates control circuitry to control the operation of the electric motor and if necessary, to sound an alarm or shut off the HVAC system.

Condensate pumps are often located in extreme environments and subjected to moisture, heat, and cold. Moreover, condensate pumps are often installed in inaccessible locations where maintenance is difficult, and therefore reliability over many years is necessary. Further, the condensate pump should operate quietly and without excessive buildup of heat from the operation of the electric motor. A condensate pump should also be able to detect an emergency overflow condition, trigger alarms, and shut down the HVAC system if necessary.

In a conventional condensate pump, a float monitors and detects the water level within the reservoir. In response to movement of the float within the reservoir, associated float switches and a float control circuitry control the operation of the electric motor, trigger alarms, or shut down the HVAC system if necessary. The condensate pump float is in contact with the water in the reservoir and is subject to fouling from debris and algae buildup. A molded float has seams, which may fail causing the float to sink or malfunction. The float switch that is used to control the on/off operation of the electric motor is often a specialized and costly bi-stable snap-action switch. A conventional condensate pump that incorporates a safety HVAC shut off switch and/or or an alarm switch, in addition to the motor control switch, may have a separate float or linkage to operate the HVAC shutoff switch or the alarm switch further complicating the condensate pump. Further, conventional condensate pumps often require a float mechanism retainer to prevent shipping damage, and the float mechanism retainer must be removed prior to pump use.

SUMMARY OF THE INVENTION

The present invention addresses the issues raised by the installation of a condensate pump in an extreme environment.

Particularly, the condensate pump of the present invention is capable of operating reliably in such an extreme environment over an extended period of time.

In order to achieve the objects outlined above, the condensate pump of the present invention includes a floatless water level sensing device which detects the water level within the reservoir and in response to detecting the water level in the reservoir, the floatless water level sensing device controls the operation of the electric pump motor, controls the operation of alarms, and if necessary, shuts down the HVAC system.

Specifically, in one embodiment, the floatless water level sensing device for the condensate pump of the present invention comprises an ultrasonic transducer connected to a microcontroller. The microcontroller generates the ultrasonic frequency to drive the ultrasonic transducer. The ultrasonic signal produced by the ultrasonic transducer reflects off of the condensate water in the reservoir, and the ultrasonic transducer receives the reflected ultrasonic signal. The reflected ultrasonic signal is then connected from the ultrasonic transducer to the microcontroller. From the reflected ultrasonic signal, the microcontroller determines the level of the water in the reservoir and controls the electric pump motor, the alarms, and the shut down of the HVAC system.

In another embodiment of the floatless water level sensing device, one or more capacitance sensors are employed to detect the water level in the reservoir. As the water level changes, the capacitance of the sensor changes. The change in capacitance produces an output signal that is connected to a microcontroller. The microcontroller determines the level of the water in the reservoir based on the signal from the capacitance sensor and controls the electric pump motor, the alarms, and shut down of the HVAC system.

The presence of the low cost microcontroller as part of the water level sensor system results in numerous advantages. The motor control provided by the microcontroller is solid state thereby being completely silent and not subject to contact arcing, contact welding, or contact corrosion. The pump activation water levels are permanently stored in the memory of the microcontroller and are not subject to variation as may be the case with a mechanical float arm that bends or is otherwise damaged such as in shipment.

The presence of the low cost microcontroller as part of the water level sensor allows for additional features in the condensate pump that are not possible with mechanical floats and float switches. For example, the microcontroller can make and store precision time measurements, water level comparisons, pump and alarm output control parameters, and system metrics such as the number of pump starts. The microcontroller controls the operation of the high water safety switch, which shuts down the HVAC system when the water level in the reservoir exceeds the normal water level required to start the impeller pump. Particularly, the microcontroller operates the high water safety switch so that the HVAC system remains off until the condensate pump has completely emptied the reservoir. Further, the microcontroller may be programmed to impart a user selectable time delay (anti-short cycle) to delay the HVAC compressor start after a power interruption or after the microcontroller has shut down the HVAC system due to a high water safety level in the reservoir. Additional information including pump model, date of manufacture, serial number, and initial performance can be programmed into the microcontroller during manufacturing product testing. In addition, a passive RF coil datalink connected to the microcontroller allows for communication between the microcontroller and a service technician's computer terminal.

Further objects, features and advantages will become apparent upon consideration of the following detailed description of the invention when taken in conjunction with the drawings and the appended claims.

DETAILED DESCRIPTION OF THE PREFERRED EMBODIMENT

Figure 1:
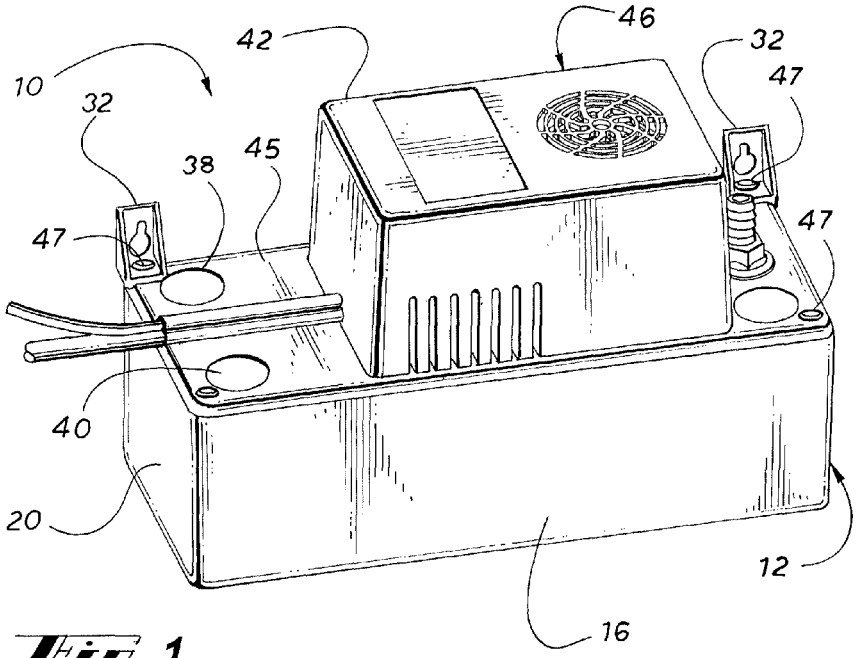
FIG. 1 is a front perspective view of the condensate pump in accordance with the present invention.
Figure 2:
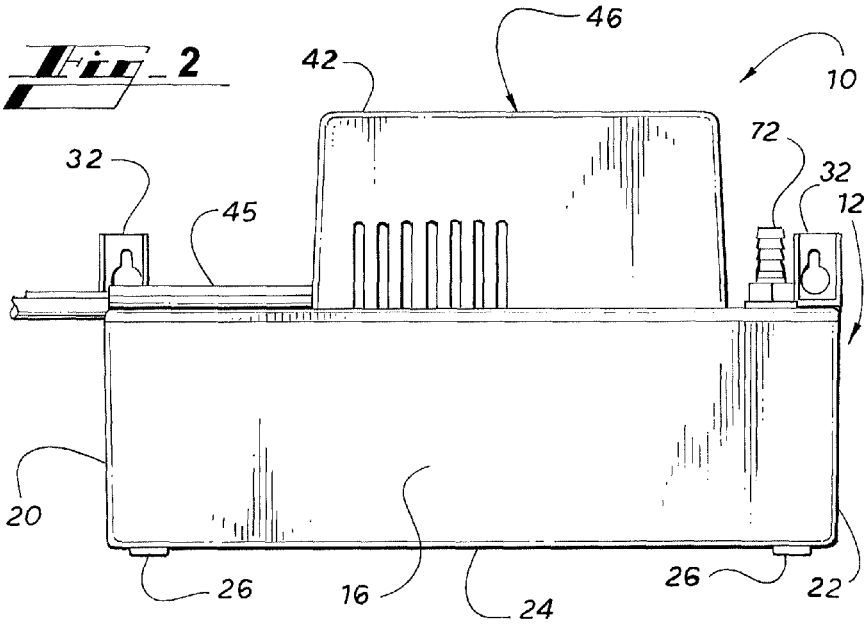
FIG. 2 is a front elevation view of the condensate pump in accordance with present invention.
Figure 3:
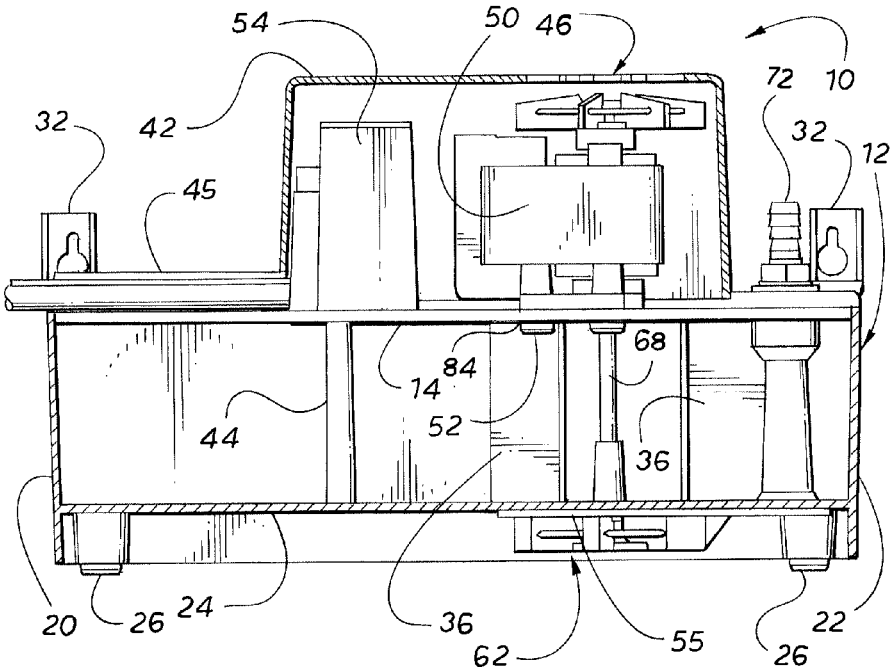
FIG. 3 is a front elevation view of the condensate pump (with the reservoir and cover transparent) in accordance with the present invention.
Figure 4:
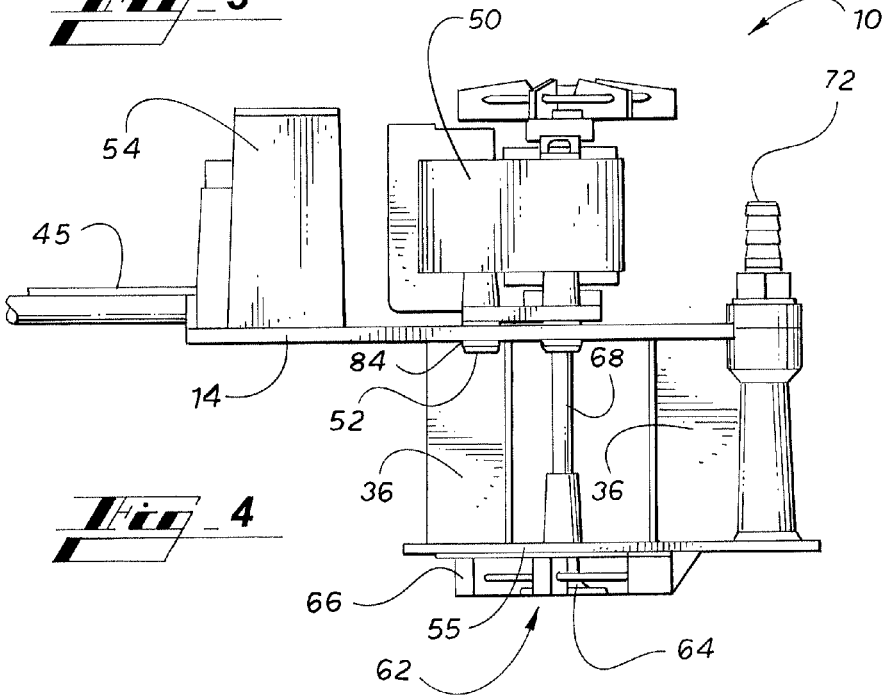
FIG. 4 is a front elevation view of the condensate pump (with the reservoir and cover removed) in accordance with the present invention.
Figure 5:
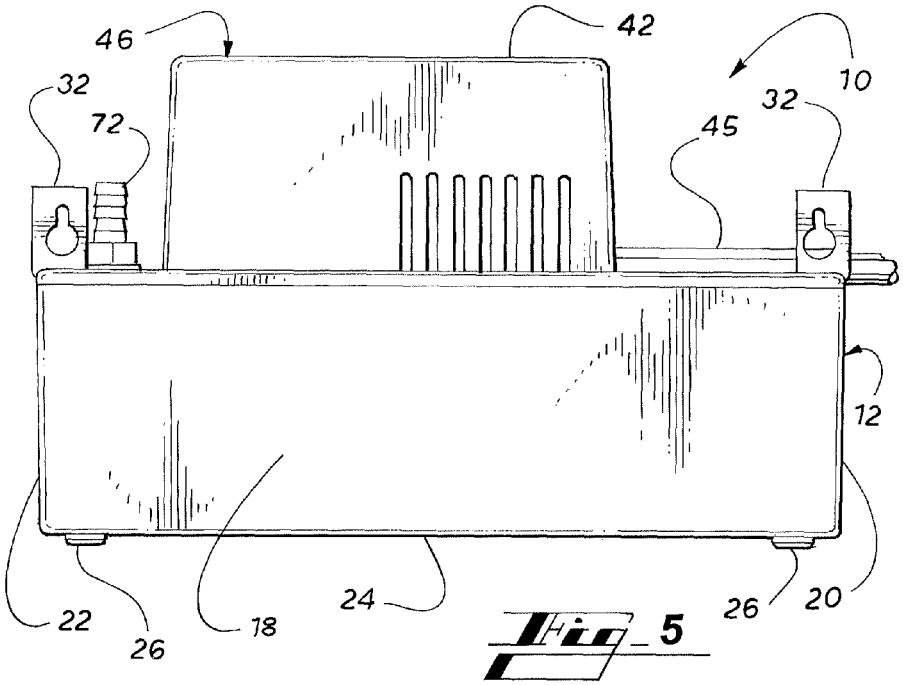
FIG. 5 is a back elevation view of the condensate pump in accordance with present invention.
Figure 6:
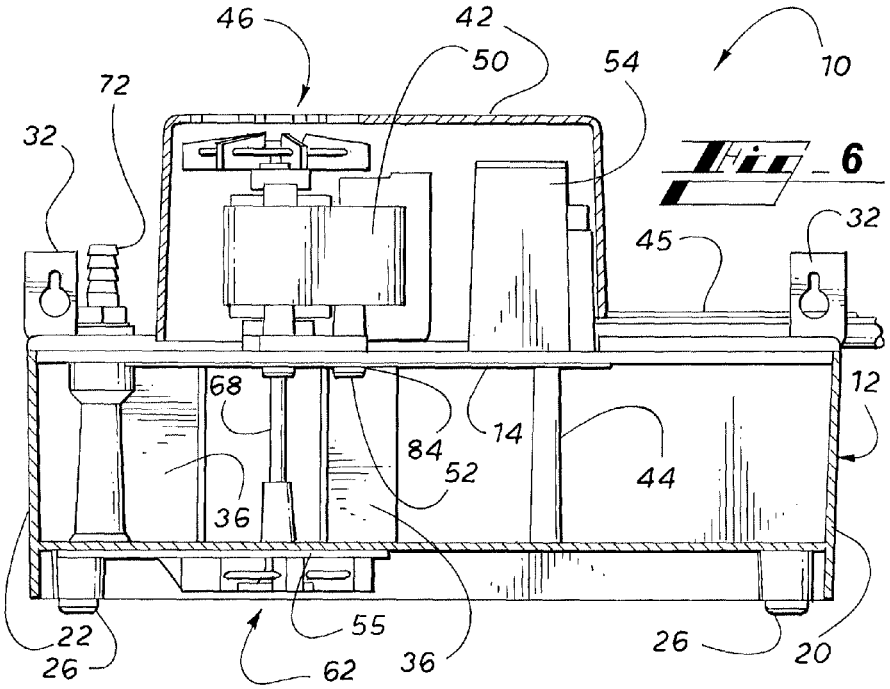
FIG. 6 is a back elevation view of the condensate pump (with the reservoir and cover transparent) in accordance with the present invention.
Figure 7:
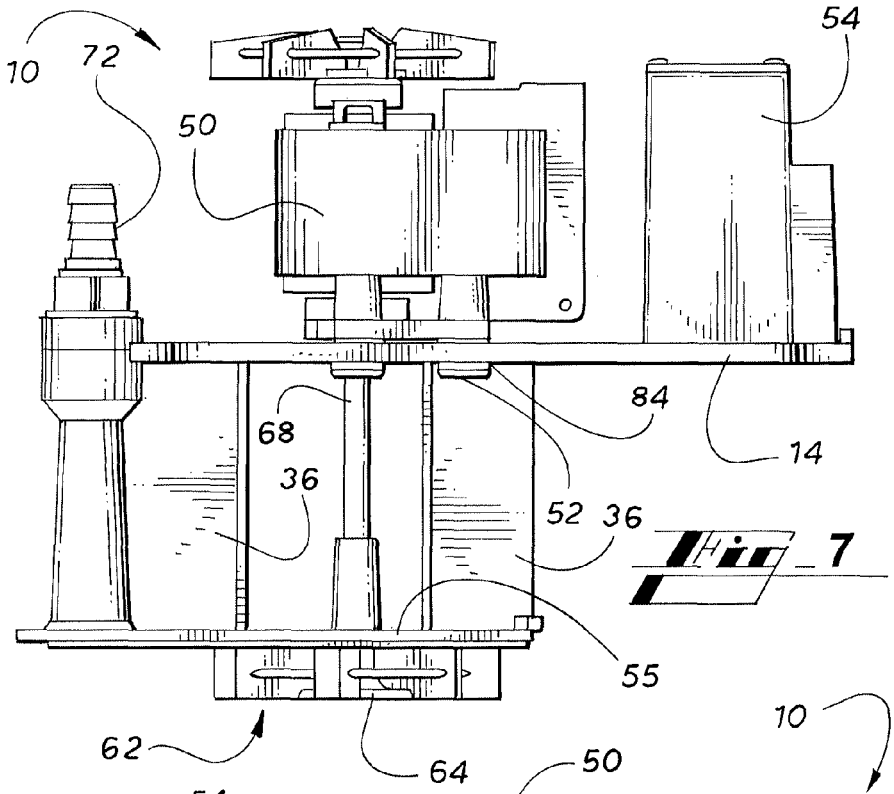
FIG. 7 is a back elevation in view of the condensate pump (with the reservoir and cover removed) in accordance with the present invention.

Turning to FIG. 1-7, a condensate pump 10 in accordance with the present invention comprises a reservoir 12, a top cover 46, and a support plate 14 (FIG. 4). The reservoir 12 comprises a water tight container with a front panel 16, a back panel 18, a left side panel 20, a right side panel 22, and a bottom panel 24. The reservoir may be of any geometric shape. The reservoir 12 has rubber support legs 26 located on the four corners of the bottom panel 24.

The top cover 46 comprises a cowl 42 and a flat base 45. The flat base 45 of the cover 46 is attached to the top of the reservoir 12 by means of cover screws 47. In addition, hanger brackets 32 are mounted to the reservoir 12 by means of the cover screws 47 adjacent the reservoir back panel 18. The hanger brackets 32 are used to mount the condensate pump 10 on a wall or other elevated support in order to make later access to the condensate pump 10 in some cases easier. The cowl 42 covers and protects pump motor 50 and control module 54. The flat base 45 of the cover 46 also has inlet openings 38 in the four corners of the flat base 45. Plugs 40 cover the inlet openings 38 that are not in use.

Figure 8:
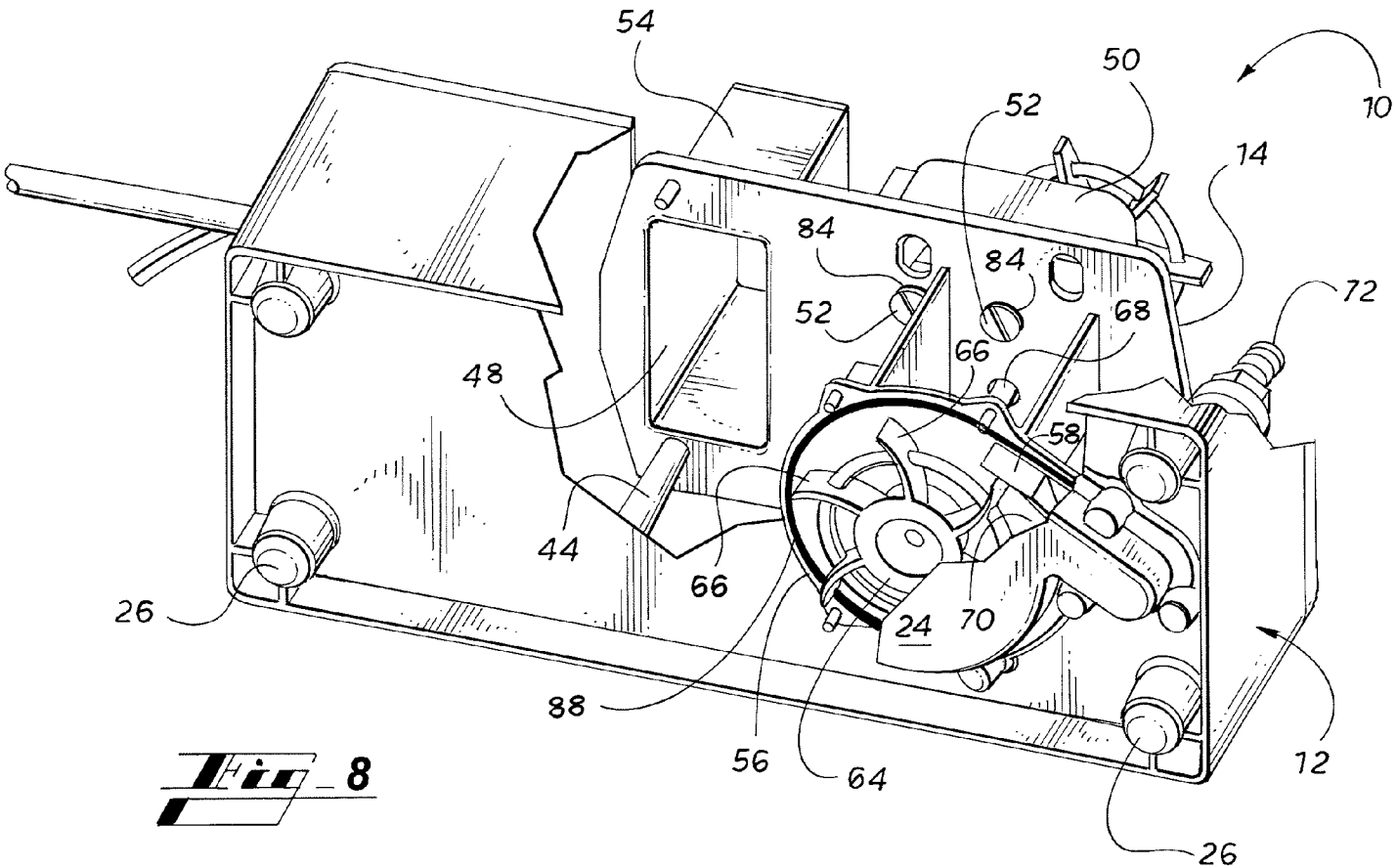
FIG. 8 is a bottom perspective view of the condensate pump (with the reservoir transparent) in accordance with the present invention.
Figure 9:
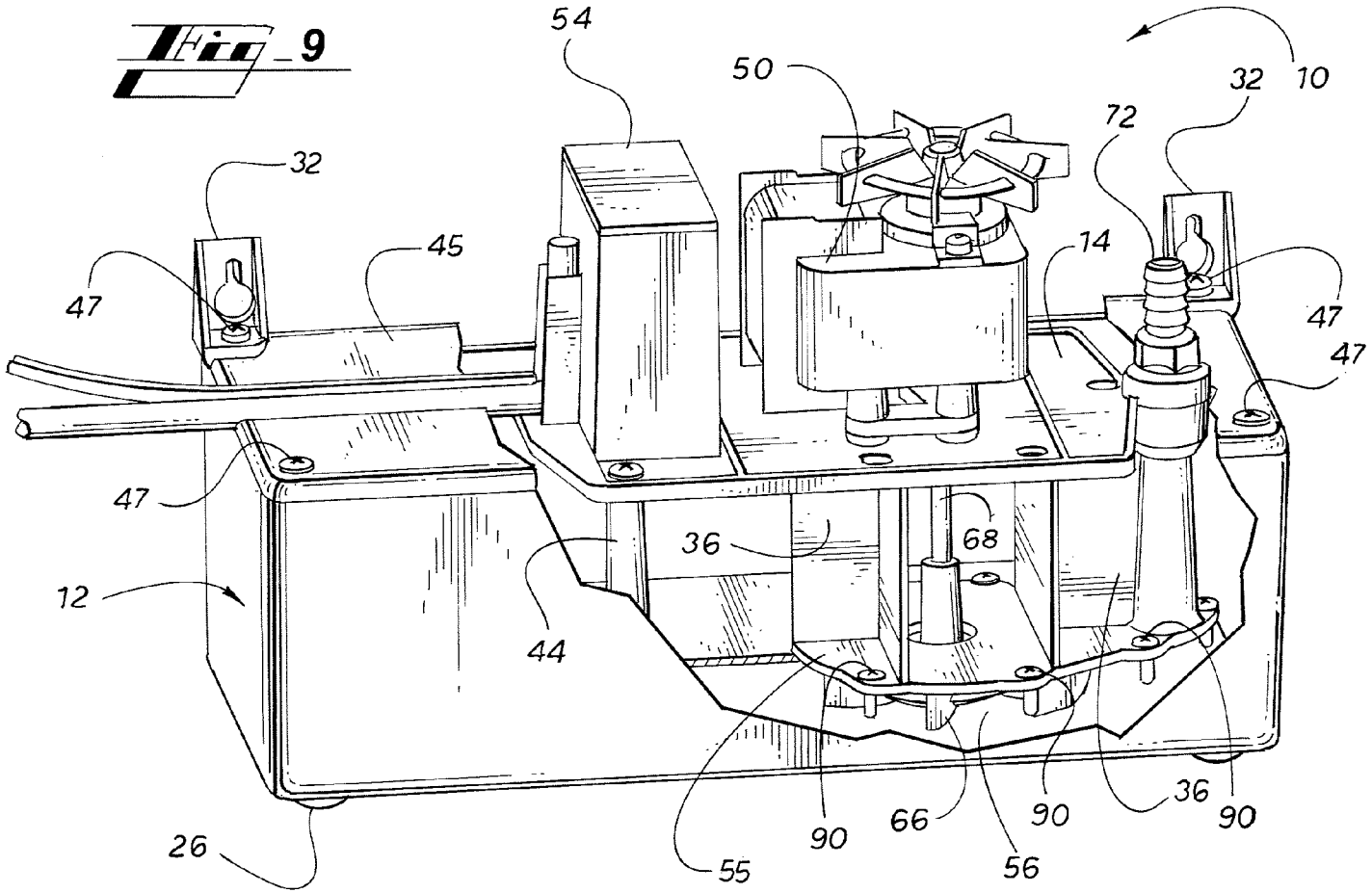
FIG. 9 is a top perspective view of the condensate pump (with the reservoir transparent and cover removed) in accordance with the present invention.
Figure 11:
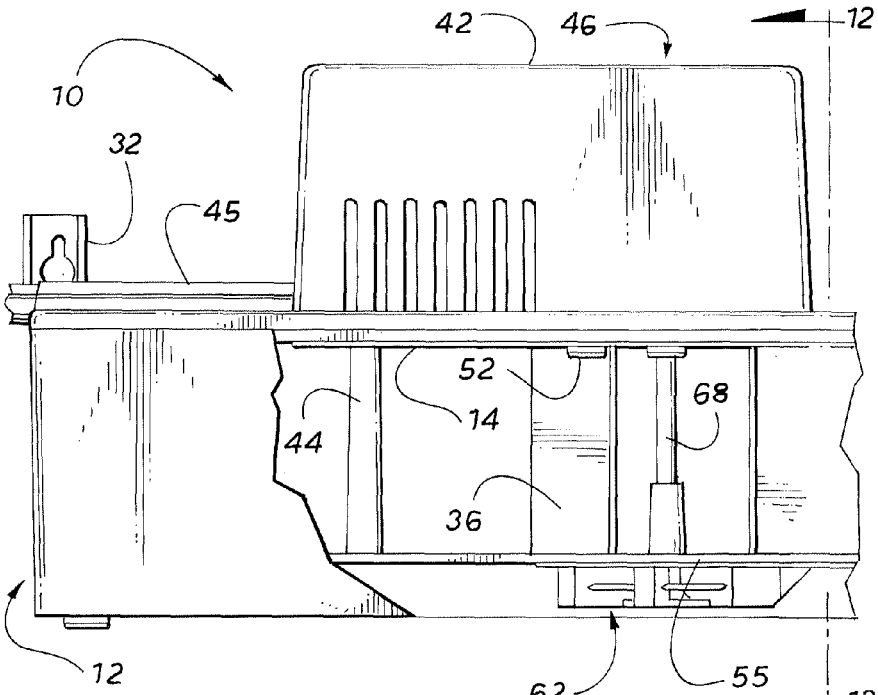
FIG. 11 is a front elevation view of the condensate pump in accordance with the present invention.
Figure 12:
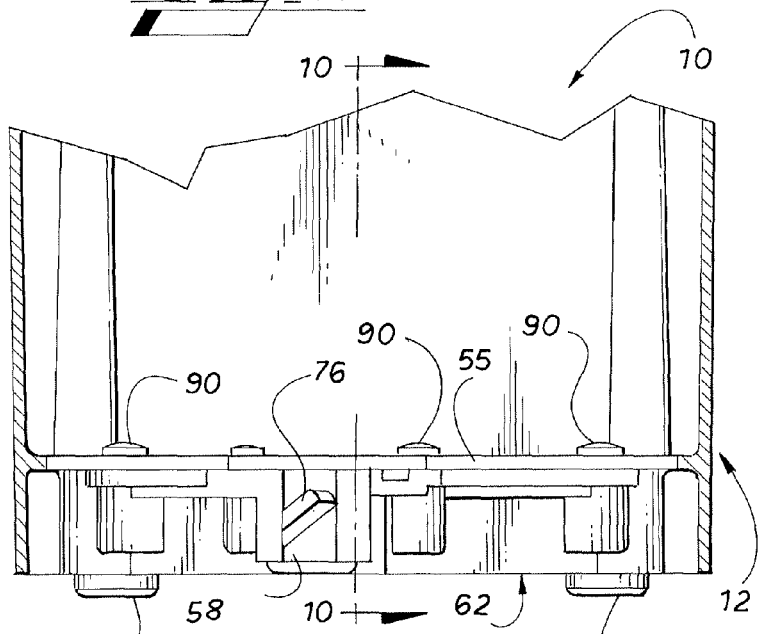
FIG. 12 is a side elevation cross-section view of the condensate pump in accordance with the present invention as seen along line 12-12 in FIG. 11.
Figure 13:
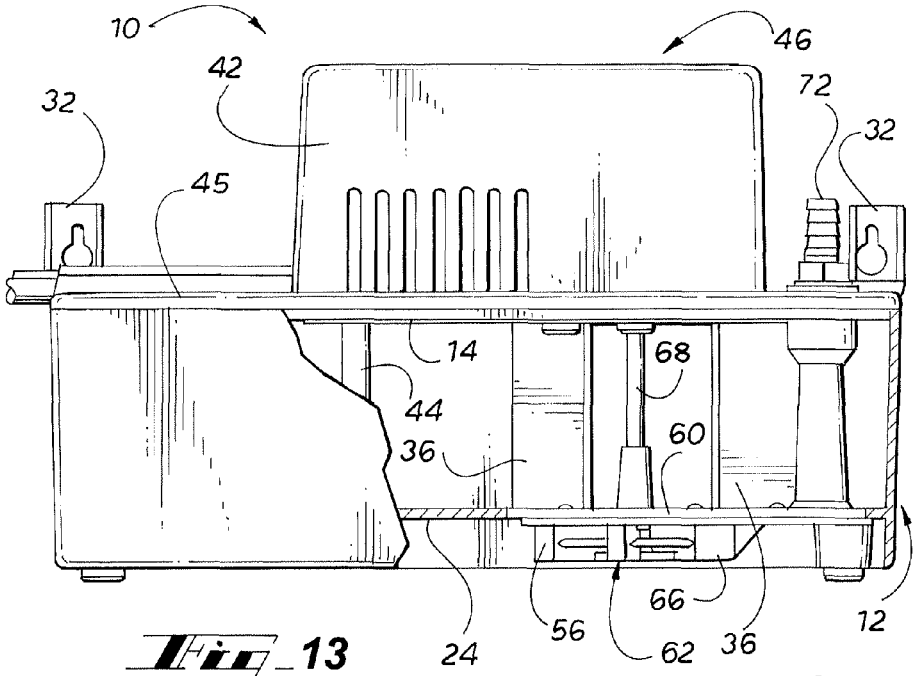
FIG. 13 is a partial front elevation view of the condensate pump in accordance with the present invention.
Figure 14:
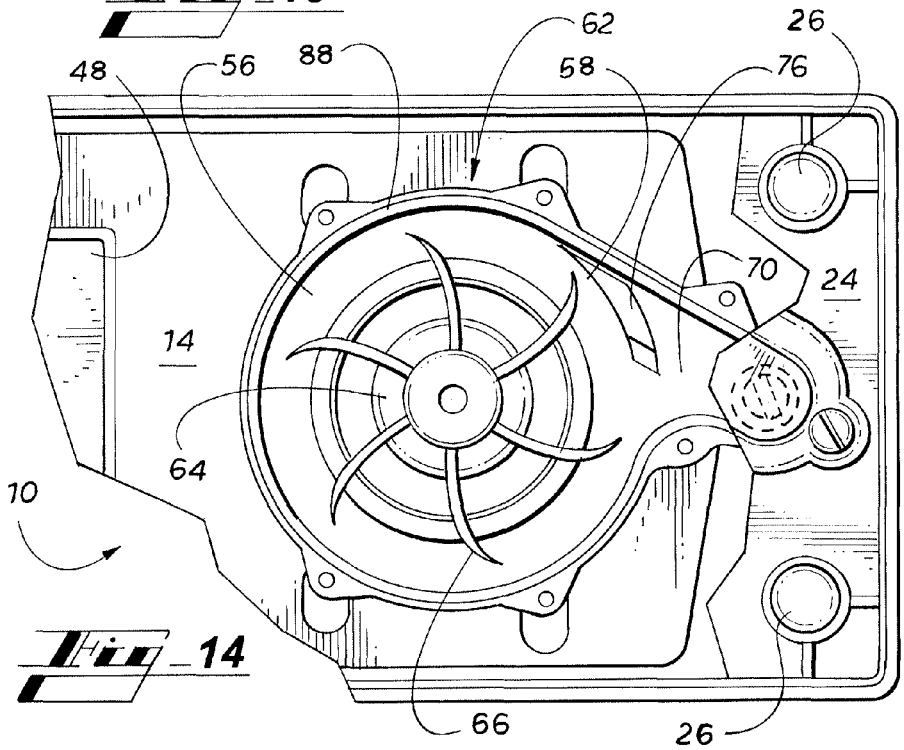
FIG. 14 is a bottom plan cross section view of the impeller pump of the condensate pump in accordance with the present invention as seen along line 14-14 in FIG. 13.

The support plate 14 forms a support backbone for the pump motor 50, impeller pump 62, and control module 54. A condensate water outlet connector 72 is mounted on one end of the support plate 14. As shown best in FIGS. 4 and 7, the motor 50 is connected on top of the support plate 14 by means of pump motor screws 52, which include rubber isolation bushings 84. A volute chamber top 55 of the impeller pump 62 is connected to the support plate 14 by means of downwardly extending pump support legs 36 that are integrally molded with the support plate 14. The volute chamber top 55 is integrally molded with the support legs 36. The control module 54 is mounted on top of the support plate 14. An access opening 48 (FIG. 8) in the support plate 14 below the control module 54 allows an ultra sonic transducer 86 (FIG. 15) to have acoustic access to the interior of the reservoir 12. A driveshaft 68 extends between the pump motor 50 and the impeller pump 62.

In order to mount the support plate 14 within the reservoir 12, the reservoir 12 has a volute chamber 56 with a connecting output conduit 70 molded into the bottom panel 24 of the reservoir 12. In addition, the bottom panel 24 of the reservoir 12 has plate support legs 44 molded into and extending upwardly toward the support panel 14. The support plate 14, with its attached motor 50, pump support legs 36, and volute chamber top 55, is attached to and supported by the volute chamber 56 and the plate support legs 44. Particularly, the volute chamber top 55 is mounted on the volute chamber 56 by means of screws 90 and a gasket 88 in order to enclose the volute chamber 56 and the output conduit 70.

Figure 10:
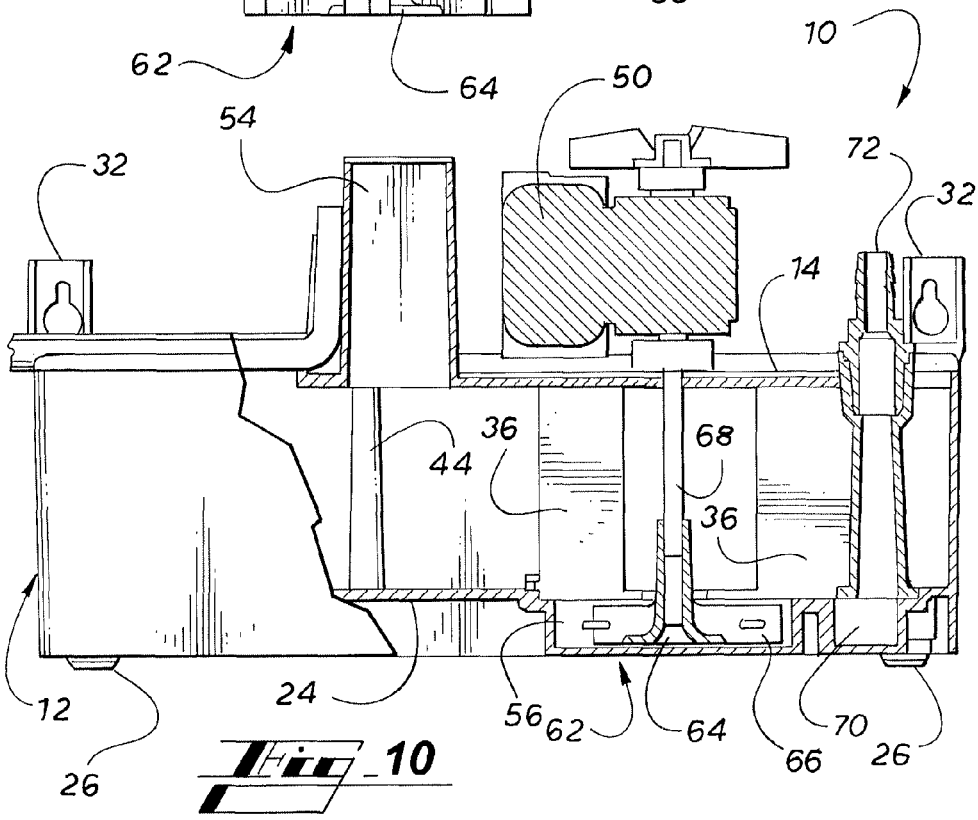
FIG. 10 is a front elevation cross-section view of the condensate pump in accordance with the present invention as seen along the line 10-10 in FIG. 12.

Turning to FIGS. 11-14, an impeller 64 with impeller blades 66 is mounted for rotation within the cylindrical volute chamber 56 of the impeller pump 62. The volute chamber 56 is cylindrical in shape with a central intake port 60 in the volute chamber top 55 (FIG. 10) and a tangential output port 58. The tangential output port 58 is connected to outlet conduit 70, and the outlet conduit 70 is connected to the water outlet connector 72. The impeller 64 is connected to impeller driveshaft 68 and is driven by the electric pump motor 50. In operation, the impeller 64 draws condensate water from the reservoir 12 into the central intake port 60 in the volute chamber top 55. The impeller 64 then forces the condensate water out through tangential output port 58, through outlet tube 70, and through outlet connector 72.

In order to reduce noise of the impeller pump 62, the tangential output port 58 has swept diagonal surfaces 76, which are beveled in order to provide a smooth and elongated transition from the radial motion of the water between each of the impeller blades 66 to the tangential direction of the tangential output port 58. Absent the smooth and elongated transition created by the swept diagonal surfaces 76, the water is forced in a conventional impeller pump to change immediately from a radial direction to a tangential direction causing a pronounced pounding sound as each impeller blades 66 passes by the tangential output port 58. By smoothing and elongating the transition, the water gradually changes direction from radial to tangential thereby resulting in far less pump noise.

The control module 54 detects the level of condensate water in the reservoir 12. In response to the level of the water in the reservoir 12, the control module 54 starts and stops the pump motor 50, sounds an alarm if necessary, and shuts off the HVAC system if necessary. Particularly, when the condensate water is at a first low level, the control module 54 stops the pump motor 50. When the condensate water reaches a second intermediate level, the control module starts the pump motor 50 so that the impeller pump 62 can pump the condensate water out of the reservoir 12. Once the condensate water level returns to the first low level in the reservoir 12, the control module 54 again stops the pump motor 50. In the case of a condensate pump failure, the water in the reservoir 12 may rise to a third high level indicating a near overflow condition. When the control module 54 detects that the water has risen to the third high level in the reservoir 12, the control module 54 sounds an alarm and shuts down the HVAC system.

Figure 15:
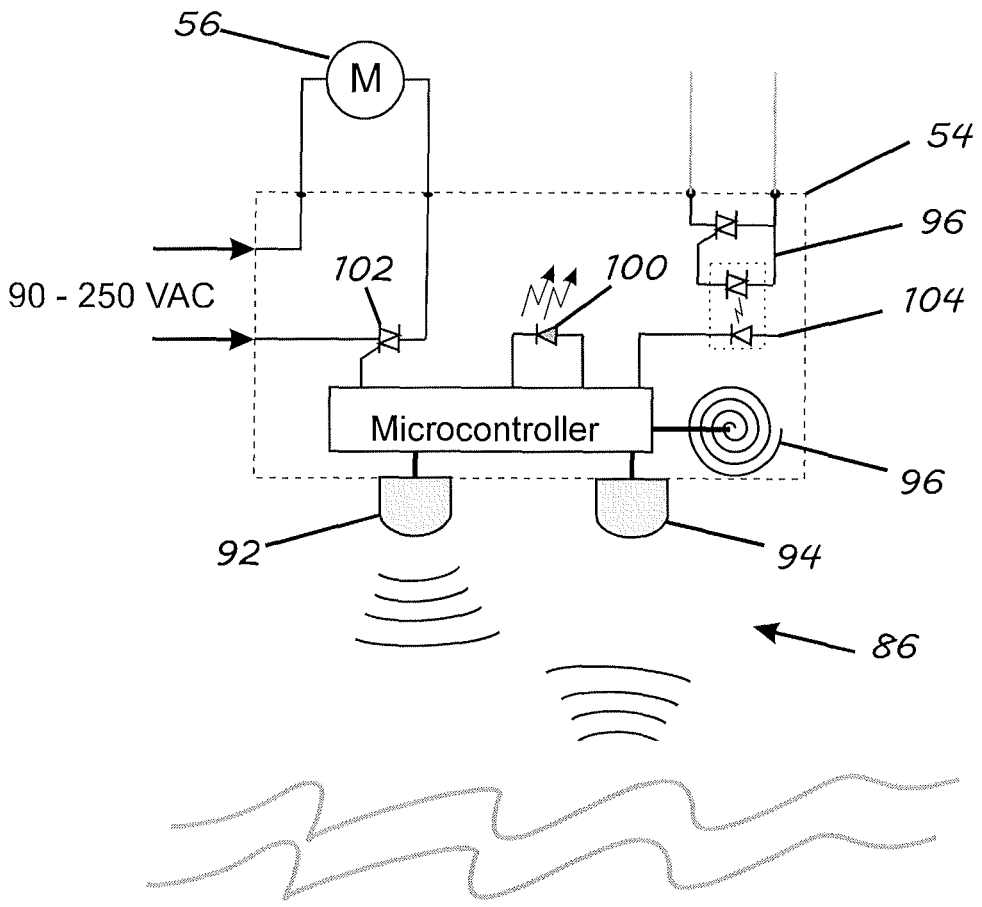
FIG. 15 is a schematic of the floatless water level detection device in accordance with the present invention.

Turning to FIG. 15, the control module 54 has a small printed circuit board that holds and interconnects all the components including the ultrasonic transducer 86 (including ultrasonic transmitter 92 and ultrasonic receiver 94), a power supply (not shown), a microcontroller 98, motor control switch 102, a high water alarm switch 104, and a high water safety switch 106. The microcontroller 98 generates an ultrasonic signal that drives the ultrasonic transmitter 92. The ultrasonic transmitter 92 in turn produces an ultrasonic output signal directed into the reservoir 12 through the access opening 48 in the support plate 14. The microcontroller 98 also receives an ultrasonic echo signal from the ultrasonic receiver 94. The microcontroller 98 processes the ultrasonic signal from the ultrasonic receiver 94 to determine the level of the condensate water in the reservoir 12. As the condensate water rises in the reservoir 12, the time between the "ping" from the ultrasonic transmitter 92 and the echo received by the ultrasonic receiver 94 becomes shorter. The times between ping and echo are approximately: 600 usec for low water level (empty reservoir), 400 usec for the intermediate water level (full reservoir), and 300 usec for the high water level (near overflow condition).

The microcontroller 98 also allows for monitoring and processing various metrics concerning the operation of the condensate pump 10, such as for example precision time measurement, water level comparison, pump motor and alarm output control, and the number of pump starts. The microcontroller 98 is also connected to a light emitting diode 100 that can be used to flash diagnostic codes for a service technician. Additional information including pump model, date of manufacture, serial number, and initial performance can be programmed into the microcontroller 98 during manufacturing product testing to be used for later tracking and diagnostic purposes.

The control module 54 also has a passive RF coil datalink 96 connected to the microcontroller 98 so that data compiled by the microcontroller 98 can be downloaded to a service technician's computer terminal. The passive RF coil datalink 96 enables bidirectional radio frequency communication of operational status and manufacturing information from the pump and provides a data path to and from the condensate pump controller for the inclusion into the pump controller of operational set points during pump manufacture and subsequent service operations.

The control module 54 with its microcontroller 98, ultrasonic transducer 86, and solid-state switches 102, 104, and 106 produces numerous benefits that are not available with a conventional float mechanism. Particularly, ultrasonic transducer 86 with its transmitter 92 and receiver 94 does not touch the condensate water in the reservoir 12. Consequently, there are no floats or moving parts to foul or break. Because of control module 54 utilizes a solid-state switch 102 to control the motor 50, motor control is completely silent, and there are no switch contacts that can arc or weld. Use of the microcontroller 98 allows the pump activation water levels (low, intermediate, and high) to be stored in permanent memory. Consequently, there are no float arms to bend and shipping damage to float switch that can affect performance of the condensate pump 10.

The microcontroller 98 also controls an LED indicator 100 so that the LED indicator 100 blinks codes indicating for example system power, timer operation, pump run, and alarm conditions. The microcontroller 98 is programmed so that the safety switch 106 shuts down the HVAC system when the condensate water is at the third high level (near overflow), and the safety switch 106 keeps the HVAC system down until the impeller pump 62 completes a full pumping cycle, and the condensate water level has reached the first low level (reservoir empty). The microcontroller 98 can also be programmed as an anti-short cycle timer. The anti-short cycle timer may be used to delay start of the HVAC compressor after a power interruption or operation of the safety switch 106 so that the HVAC compressor is automatically protected against compressor short cycling. The microcontroller 98 may also be programmed so that the safety switch 106 is automatically opened on loss of power to condensate pump 10.

When power is first applied to the condensate pump 10, the safety switch 106 and motor switch 102 are open (off). If the microcontroller 98 is programmed for a time delay start of the HVAC system, the time delay begins, and the LED indicator flashes the timer code of two blinks as indicated in Table 1 below (anti-short cycling time are operating-pump off) until timing is complete. Once the time delay has elapsed, the microcontroller 98 closes the safety switch 106 to start the HVAC system, the pump motor 50 remains off, and the LED indicator shows solid (power on, pump not operating). Once the condensate water reaches the second intermediate level, the signal from the ultrasonic receiver 94 causes the microcontroller 98 to start the pump motor 50, and the LED indicator slowly flashes (pump running, normal pump down cycle). Once the condensate water reaches the first low level again, the microcontroller 98 opens motor control switch 102 to stop the pump motor 50, and the LED indicator 100 returns to the solid blink code.

If the condensate water reaches the third high level (near overflow), the microcontroller 98 causes the pump motor 50 to continue running, shuts down the HVAC system, and causes the LED indicator 100 to blink rapidly (pump running, alarm level). When the condensate water again reaches the first low level, the microcontroller 98 starts the anti-short cycle timer so that the restart of the HVAC system is delayed.

TABLE 1

| Condition | Blink Code | Motor Switch 102 | Safety switch 106 |
|---|---|---|---|
| Power On, Pump Not Operating | ********** (solid on) | open | closed |
| Anti-short-cycle timer operating-Pump Off | *-*----------(2 Blinks) | open | open |
| Anti-short-cycle timer operating-Pump On | *-*-*----------(3 Blinks) | closed | open |
| Pump Running, Norm Pumpdown Cycle | ***-----***-----(Slow Flashing) | closed | closed |
| Pump Running, Alarm Level | *-*-*-*-*-*-*-*-(Rapid Blinking) | closed | open |

Figure 16:
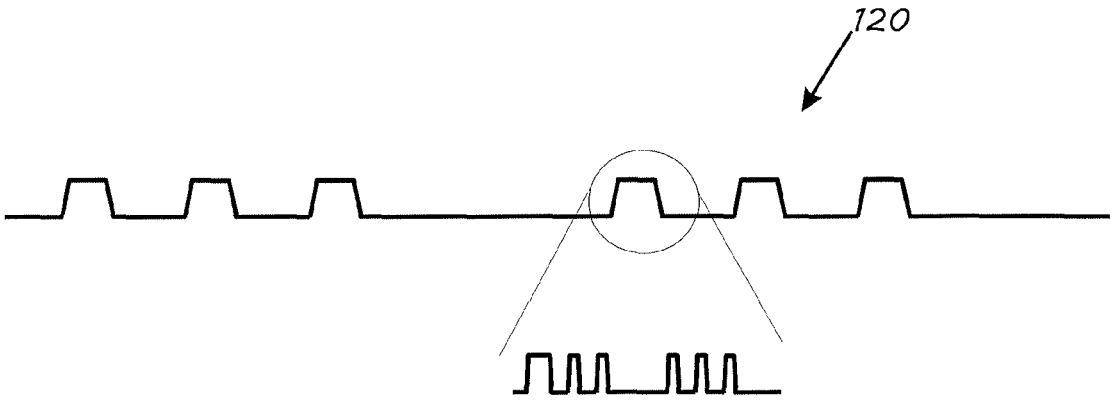
FIG. 16 is a schematic of a communication circuit for the floatless water level detection device in accordance with the present invention.
Figure 16:
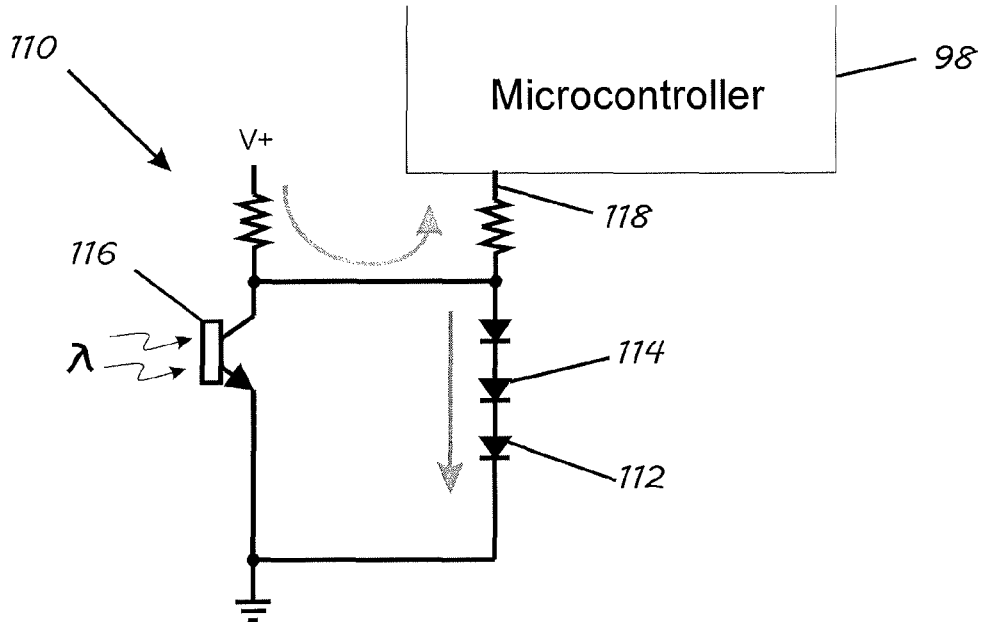

FIG. 16 discloses an LED communication circuit 110 that may be used as an alternative to the passive RF coil datalink 96. Instead of the passive RF coil datalink 96, the microcontroller 98 is connected to the LED communication circuit 110 so that data compiled by the microcontroller 98 can be downloaded to a service technician's computer terminal and so that service parameters can be programmed into the condensate pump from the technician's computer terminal.

The LED communication circuit 110 of the floatless condensate pump controller 54 includes a visible signal emitting LED 112, an infrared emitting LED 114, and an infrared sensitive phototransistor 116 connected to a single input/output pin 118 of the floatless condensate pump controller microcontroller 98. The visible LED 112, the infrared LED 114, and infrared phototransistor 118 are electrically arranged to simultaneously emit visible and invisible information regarding operation of the pump. During the visibly ON periods of the LED, blink codes 120 containing high speed serial data are integrated by the operator's eye into single easily detectible blinks of the visible LED while the embedded infrared pulses remain detectible to remote pump diagnostic equipment. The infrared photo detector 116 collects serial data and commands from externally located computer terminal, and infrared photo detector 116 is biased in order to generate a signal at the input/output pin 118 of the microcontroller 98 during LED dark periods. Consequently, the infrared photo detector 116 can be used to load operating parameters into the microcontroller 98. Such operating parameters may include, among others, manufacturing data such as serial numbers, and date of manufacture and may be used to stimulate latent diagnostic and operational modes as well as setting operational parameters including water levels, time delays and alarm trip points.

Figure 17:
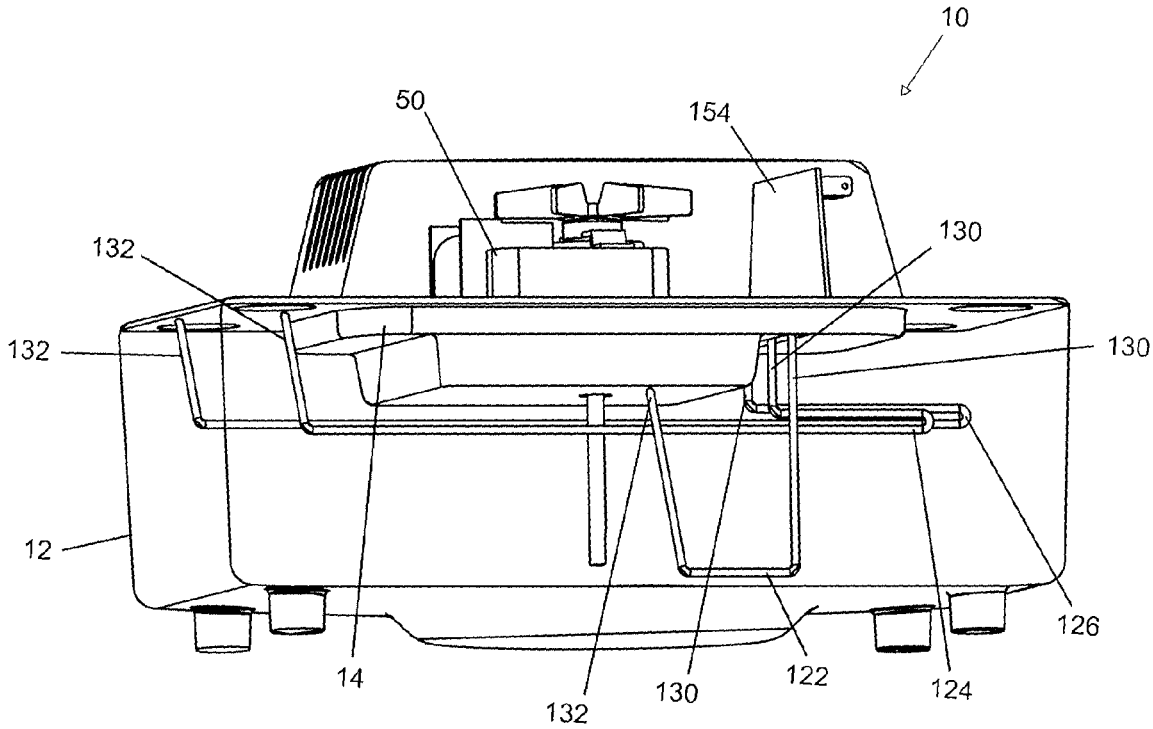
FIG. 17 is a perspective view of a capacitance sensor array for the floatless water level detection device in accordance with the present invention.

In an alternative embodiment of the condensate pump 10, a capacitance sensor system, such as capacitance sensor systems 140 and 240 (FIGS. 18 and 19), is employed to determine the level of water in the reservoir 12 and thereby control the operation of the pump motor 50 and, if necessary, control an alarm and the HVAC system. The capacitance sensor system 140 has a control module 154 (FIG. 18), and the capacitance sensor system 240 has a control module 254 (FIG. 19). Turning to FIG. 17, the support plate 14 supports the control module (such as control module 154), a low water capacitance sensor 122, an intermediate water capacitance sensor 124, and a high water capacitance sensor 126. Each capacitance sensor 122, 124, or 126 has a first end 130 connected to the control module (such as control module 154) and a second end 132 that is unconnected. The low water capacitance sensor 122 senses when the water in the reservoir 12 has reached a low level so that the pump motor 50 can be turned off after a pump cycle. The intermediate water capacitance sensor 124 senses when the water in the reservoir 12 has reached an intermediate level so that the pump motor 50 can be turned on to pump water out of the reservoir 12. The high water capacitance sensor 126 senses when the water in the reservoir 12 has reached a critically high level (approaching overflow) so that the HVAC system can be turned off and an alarm activated while the pump motor 50 continues running.

Figure 18:
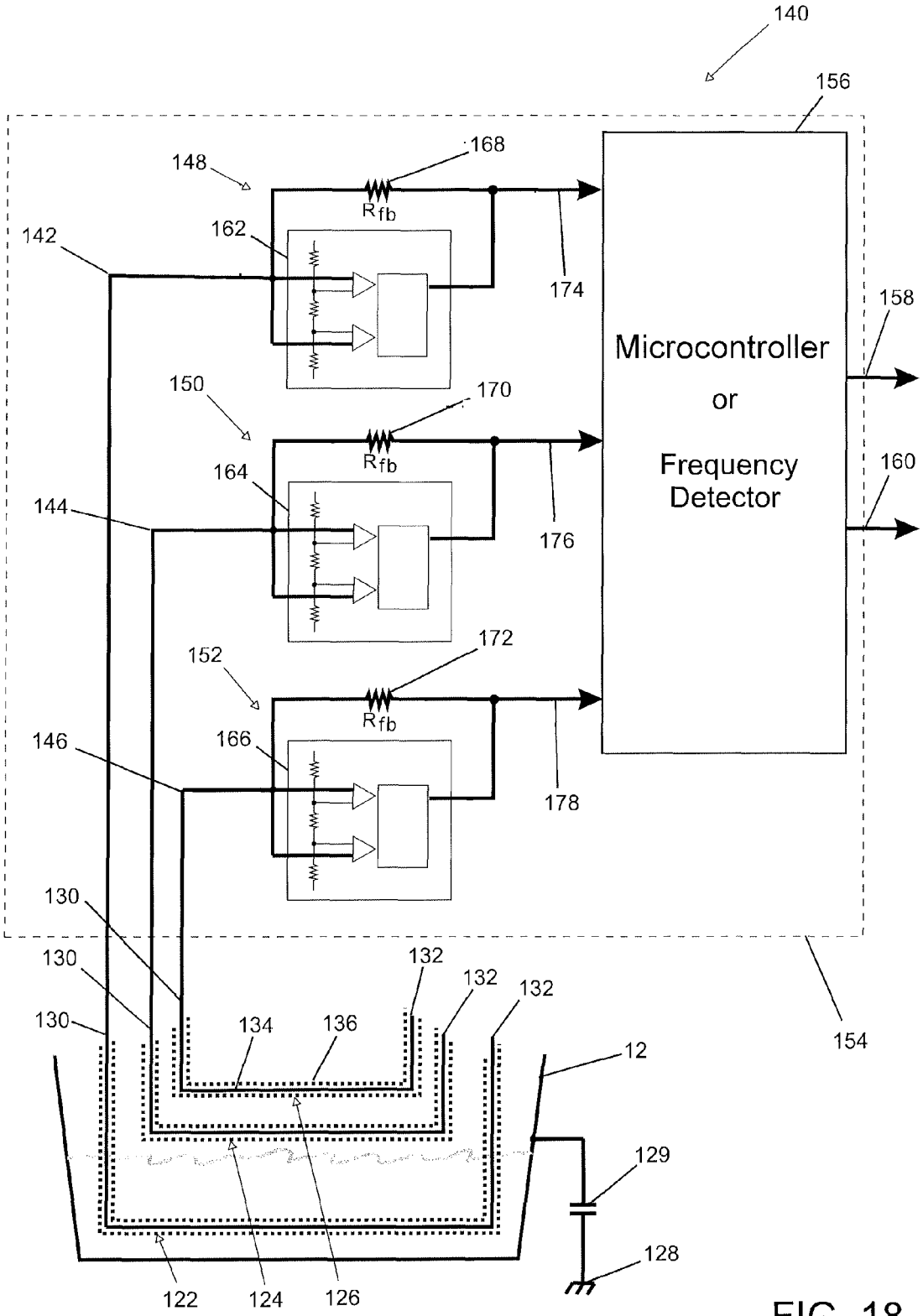
FIG. 18 is a schematic diagram of one embodiment of a capacitance sensor circuitry for the floatless water level detection device in accordance with the present invention.
Figure 19:
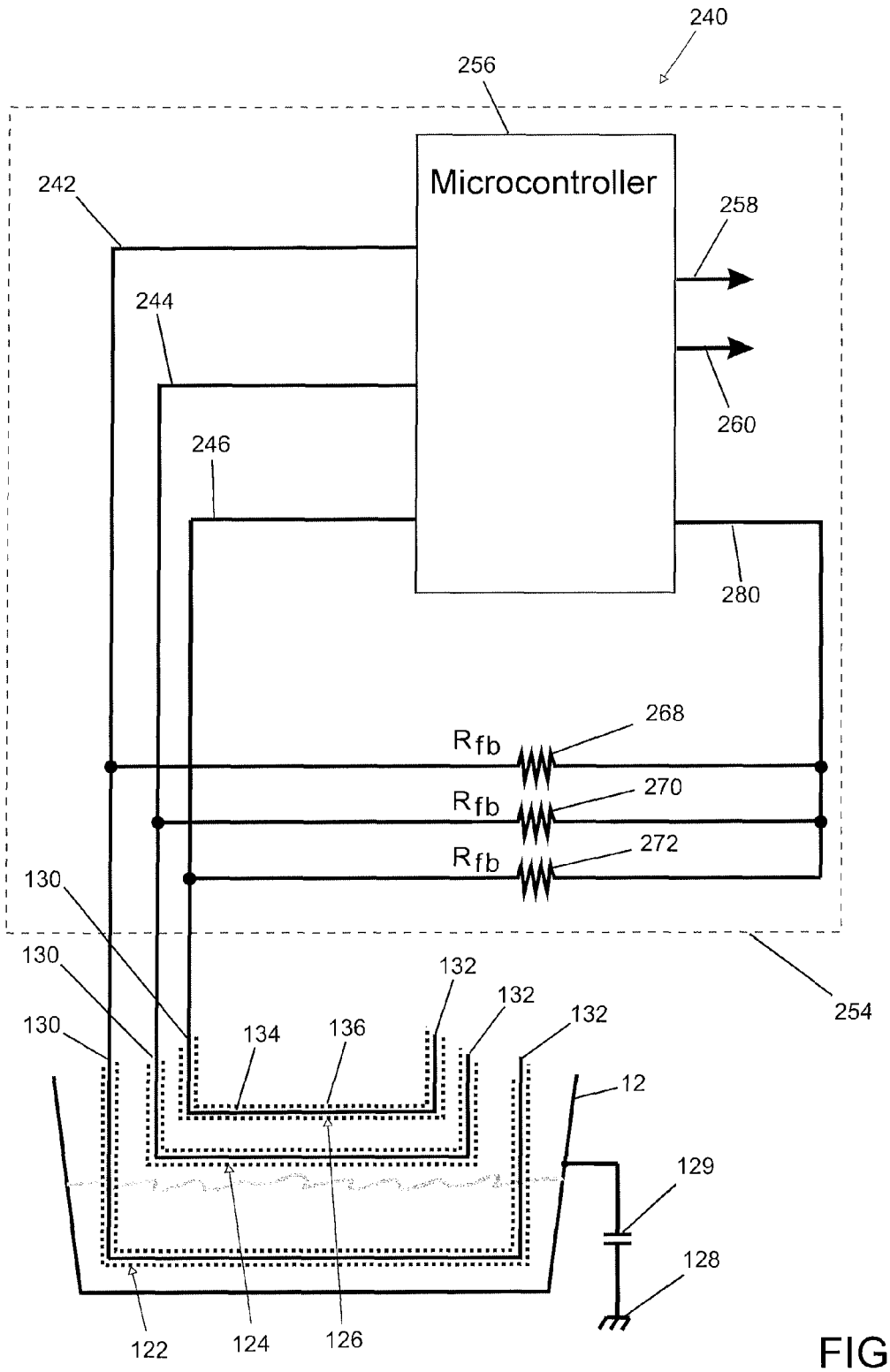
FIG. 19 is a schematic diagram of another embodiment of a capacitance sensor circuitry for the floatless water level detection device in accordance with the present invention.

As shown in FIGS. 18 and 19, each of the capacitance sensors 122, 124, and 126 consists of a wire conductor 134 surrounded by insulation 136. The insulation 136 can be any appropriate electrical insulation that serves as a dielectric and does not deteriorate or become fouled when subjected to the condensate water in the reservoir 12. Polyvinyl chloride installation and polyethylene installation are both useful in carrying out the present invention. Polyethylene has the additional advantage of avoiding fouling by material attaching to it from the condensate water in the reservoir 12. One end 130 of each of the capacitance sensors 122, 124, and 126 is respectively connected to inputs 142, 144, and 146 of the control module 154 (FIG. 18), and the one end 130 of each of the capacitance sensors 122, 124, and 126 is respectively connected to inputs 242, 244, and 246 of the control module 254 (FIG. 19).

Each of the capacitance sensors 122, 124, and 126 represents one plate of a capacitor formed between the wire conductor 134 of each of the capacitance sensors 122, 124, and 126 and earth ground 128 (FIGS. 18 and 19). The total capacitance value at end 130 of each of the capacitance sensors 122, 124, and 126 is the value of the capacitance sensor plus the value of the distributed capacitance 129 associated with the reservoir 12. Because the dielectric constant of water is greater than the dielectric constant of air, the capacitance value of capacitance sensors 122, 144, and 126 increases dramatically when the condensate water in the reservoir 12 contacts the insulation 136 on the capacitance sensors 122, 124, and 126. That increase in capacitance, connected to the inputs 142, 144, and 146 of the control module 154 (FIG. 18) and connected to the inputs 242, 244, and 246 of the control module 254 (FIG. 19), is used to control the pump motor 50 or, if necessary, to control the HVAC system or an alarm as will be described in greater detail in connection with FIGS. 18-20.

The capacitance sensors 122, 124, and 126 can be shaped to accommodate the physical requirements relating to the water level in the reservoir 12. For example, the low water capacitance sensor 122 can be shaped so that it extends to a point adjacent the intake 60 of the impeller pump 64 (FIG. 17). In that way, the capacitance sensor 122 can assure that the motor 50 shuts off before the intake 60 has been exposed to air instead of water in the reservoir 12. The intermediate water capacitance sensor 124 and the high water capacitance sensor 126, on the other hand, are shaped so that they extend horizontally along the length of the reservoir 12. The elongated shape ensures that, if the condensate pump 10 is supported on a slanted surface, some portion of the intermediate water capacitance sensor 124 or the high water capacitance sensor 126 is able to contact condensate water in the reservoir 12 before overflow occurs. The capacitance sensors could be bent into any shape to conform to the shape of the reservoir 12 or to focus on a particular volume within the reservoir 12.

In one embodiment of the condensate pump 10, the capacitance sensor system 140 or 240 includes the three separate capacitance sensors, low water capacitance sensor 122, intermediate water capacitance sensor 124, and high water capacitance sensor 126. Each capacitance sensor 122, 124, or 126 is connected to the control module 154 or 254. Alternatively, a single capacitance sensor may be employed, and as the condensate water level rises along the height of the capacitance sensor, the change in capacitance of the capacitance sensor is sufficient to allow the control module 154 or 254 to determine the level of condensate water in the reservoir 12.

Turning to FIG. 18, the control module 154 comprises a low water oscillator 148, an intermediate water oscillator 150, a high water oscillator 152, and a microprocessor 156. In addition to the control module inputs 142, 144, and 146, the control module 154 has motor control output 158 and HVAC and alarm control output 160. The low water oscillator 148 includes a comparator 162, a feedback resistor 168, and an oscillator output 174. The intermediate water oscillator 150 includes a comparator 164, a feedback resistor 170, and an oscillator output 176. The high water oscillator 152 includes a comparator 166, a feedback resistor 172, and an oscillator output 178. The capacitance sensors 122, 124, and 126 are connected to the control module inputs 142, 144, and 146, which in turn are connected to the inputs of the comparators 162, 164, and 166. The outputs 174, 176, and 178 of the oscillators 148, 150, and 152 are connected to inputs of the microprocessor 156. FIG. 18 illustrates a capacitance sensor system 140 in which three separate capacitor sensors 122, 124, and 128 are employed. If a single capacitance sensor is used, oscillators 150 and 152 may be eliminated.

In operation, the capacitance value at the control module input, such as input 142 determines the frequency of the oscillator 148. If, for example, the capacitance sensor 122 is in contact with the condensate water in the reservoir 12, the value of the capacitance at control module input 142 increases, and the additional capacitance at control module input 142 causes the oscillator 148 to oscillate at a reduced frequency. If the oscillator frequency is below a certain predetermined threshold level, the microprocessor 156 recognizes that low frequency as an indication that the capacitance sensor 122 is in contact with condensate water in the reservoir 12. In the embodiment where three capacitance sensors 122, 124, and 126 are employed with separate oscillators 148, 150, and 152, the microprocessor 156 responds to the change in frequency at each of its three inputs 174, 176, and 178. For example, when the condensate water in the reservoir 12 is low and none of the three capacitance sensors 122, 124, and 126 is in contact with the condensate water, all three individual oscillators 148, 150, and 152 are running at a relatively high frequency because the dry capacitance sensors have a low capacitance value. As a result, the microprocessor 156 recognizes that circumstance as a low water condition and turns off the pump motor 50 by means of a signal on motor control output 158. At the same time, the microprocessor maintains the alarm inactive and maintains the operation of the HVAC system by means of a signal on HVAC and alarm output 160. When the condensate water reaches the intermediate water capacitance sensor 124, the inputs 174, 176, and 178 connected to the microprocessor 156 include a low frequency signal on line 174 from the low water oscillator 148 connected to the low water capacitance sensor 122, a low frequency signal on line 176 from the intermediate water oscillator 150 connected to the intermediate water capacitance sensor 124, and a high frequency signal on line 178 from the high water oscillator 152 connected to the high water capacitance sensor 126. Based on that set of inputs, the microprocessor 156 turns on the pump motor 50 by means of a signal on motor control output 158 and maintains the operation of the HVAC system and the continued deactivation of the alarm by means of the signal on HVAC and alarm output 160. When the condensate water reaches the high water capacitance sensor 126, the inputs 174, 176, and 178 connected to the microprocessor 156 all have a high frequency value indicating in that the reservoir 12 may be close to overflowing. The microprocessor 156 in that situation maintains the continued operation of the pump motor 50 by means of a signal on motor control output 158 and simultaneously activates an alarm and shuts off the HVAC system by means of a signal on HVAC and alarm output 160.

Turning to FIG. 19, the capacitance sensor system 240 is similar to capacitance sensor system 140 except that the control module 254 comprises a microprocessor 256 and feedback resistors 268, 270, and 272. A low water control module input 242, an intermediate water control module input 244, and a high water control module input 246 are connected to separate inputs of the microprocessor 256. The microprocessor 256 has a feedback output 280 that is connected to input 242 through feedback resistor 268, to input 244 through feedback resistor 270, and to input 246 through feedback resistor 272. The microprocessor 256 determines the capacitance at its inputs 242, 244, and 246 by determining how long is required for the output 280 to charge each input 242, 244, or 246 to a predetermined threshold value. The time required to charge each of the inputs to the predetermined threshold value depends on the value of the capacitance connected to that particular input. If, for example, the capacitance sensor 122 is not in contact with condensate water in the reservoir 12, the resulting low capacitance value at input 242 will result in a relatively rapid charge time for the input 242 to reach its threshold value. Once the condensate water contacts the capacitance sensor 122, a substantially longer period of time will be required for the input 242 to reach its threshold value. Based on that time difference, the microprocessor 256 can determine whether the water is in contact with the capacitance sensor 122 or not.

Figure 20:
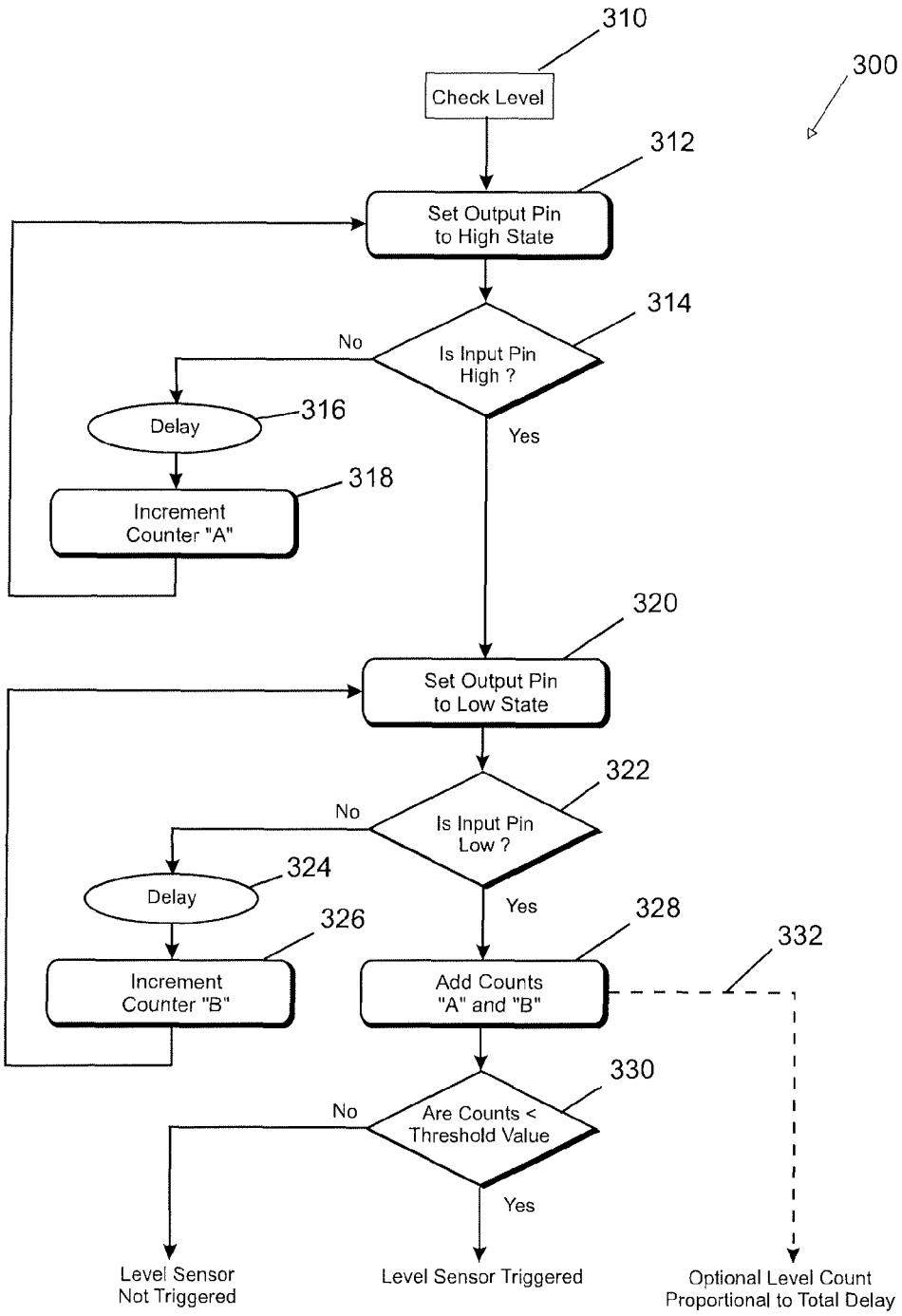
FIG. 20 is a flowchart illustrating the operation of the capacitance sensor circuitry of FIG. 19 for the floatless water level detection device in accordance with the present invention.

FIG. 20 illustrates the process 300 of the microprocessor 256 in FIG. 19 as it continuously monitors the inputs 242, 244, and 246. The method 300 begins at step 310 and proceeds to step 312, where the output 280 of the microprocessor 256 is set to a high state. From step 312, the process proceeds to step 314, where the microprocessor 256 checks to determine if the input, such as input 242, has reached a predetermined high value threshold. If the input has not reached the predetermined high value threshold, the process follows the "no" branch to step 316, where a delay is imposed. Once the delay time has expired at step 316, the process proceeds to step 318, where a counter A is incremented. From step 318, the process loops back to step 312, where the output 280 is again set to a high state. From step 312, the process proceeds again to step 314, where the process checks to determine if the input has reached the predetermined high value threshold. If the input has reached the predetermined high value threshold, the process follows the "yes" branch to step 320.

At step 320, the output 280 of the microprocessor 256 is set to a low state. From step 320, the process proceeds to step 322, where the microprocessor 256 checks to determine if the input, such as input 242, has reached a predetermined low value threshold. If the input has not reached the predetermined low value threshold, the process follows the "no" branch to step 324, where a delay is imposed. Once the delay time has expired at step 324, the process proceeds to step 326, where a counter B is incremented. From step 326, the process loops back to step 320, where the output 280 is again set to a low state. From step 320, the process proceeds again to step 322, where the process checks to determine if the input has reached the predetermined low value threshold. If the input has reached the predetermined low value threshold, the process follows the "yes" branch to step 328.

At step 328, the process of 300 adds that counts in counters A and B. From step 328, the process proceeds to step 330, where the combined counts are compared to a predetermined threshold value. If the count is less than the threshold value, the process follows the "no" branch indicating that the capacitance value of the capacitance sensor is low, and the condensate water is not in contact with the capacitance sensor. If the count is greater than the threshold value, the process follows the "yes" branch indicating that the capacitance value of the capacitance sensor is high, and the condensate water is in contact with the capacitance sensor.

In the circumstance where a single capacitance sensor is employed instead of three separate capacitor sensors, the count at step 328, which is proportional to the level of the condensate water in the reservoir 12, could be used to control the motor, the alarm, and/or the HVAC system. Particularly, the method 300 follows the optional branch 332 to control the motor, the alarm, and/or the HVAC system.

While this invention has been described with reference to preferred embodiments thereof, it is to be understood that variations and modifications can be affected within the spirit and scope of the invention as described herein and as described in the appended claims.

I claim:

1. A capacitance sensor system configured to be used in a liquid pumping system, the liquid pumping system comprising a liquid reservoir and an impeller pump located inside the reservoir to pump liquid out of the reservoir, wherein the capacitance sensor system comprises:

a. a capacitance sensor within the reservoir for contact with the liquid and having a capacitance value that depends on contact between the liquid and the capacitance sensor; and b. a control module having a microcontroller comprising:

i. a feedback output connected through a feedback resistor to an input of the microcontroller and to the capacitance sensor;

ii. a first timing counter that starts when the microcontroller sets the feedback output of the microcontroller to a predetermined high state value and stops when the input of the microcontroller reaches the predetermined high state value, the first timing counter of the microcontroller thereby determines a first time required for the feedback output to raise the input of the microcontroller connected to the capacitance sensor to the predetermined high state value;

iii. a second timing counter that starts when the microcontroller sets the feedback output to a predetermined low state value and stops when the input of the microcontroller reaches the predetermined low state value, the second timing counter of the microcontroller thereby determines a second time required for the feedback output to lower the input of the microcontroller connected to the capacitance sensor to the predetermined low state value; and iv. a comparator for comparing the combined first time and second time to a predetermined threshold to determine if the liquid in the reservoir is in contact with the capacitance sensor.

2. The capacitance sensor system of claim 1, wherein the control module further includes a status indicator light controlled by the microcontroller to indicate visually the operating status of the pump.

3. The capacitance sensor system of claim 1, wherein the control module further includes an infrared emitter and an infrared receiver connected to the microcontroller for transmitting and receiving data to and from the microcontroller.

4. The capacitance sensor system of claim 1, wherein the control module further includes an RF transceiver connected to the microcontroller for transmitting and receiving data to and from the microcontroller.

5. The capacitance sensor system of claim 1, wherein the control module further includes an alarm switch controlled by the microcontroller to sound an alarm when the liquid in the reservoir reaches a near overflow condition.

6. The capacitance sensor system of claim 1, wherein the control module further includes a safety switch controlled by the microcontroller to shut down an HVAC system when the liquid in the reservoir reaches a near overflow condition.

7. A method for determining a level of liquid in a reservoir, the method comprising the steps of:

a. locating a capacitance sensor within the reservoir for contact with the liquid, the capacitance sensor having a capacitance value that depends on contact between the liquid and the capacitance sensor;

b. connecting a feedback output of a microcontroller through a feedback resistor to an input of the microcontroller and to the capacitance sensor, c. setting the feedback output of the microcontroller to a predetermined high state value;

d. determining a first time required for the feedback output to charge the capacitance sensor connected to the input of the microcontroller to the predetermined high state value;

e. setting the feedback output of the microcontroller to a predetermined low state value f. determining a second time required for the feedback output to charge the capacitance sensor connected to the input of the microcontroller to the predetermined low state value;

g. combining the first time and the second time; and h. comparing the combined first time and second time to a predetermined threshold to determine if the liquid in the reservoir is in contact with the capacitance sensor.

* * * * *